US008732888B2

(12) United States Patent
Duwa

(10) Patent No.: US 8,732,888 B2
(45) Date of Patent: May 27, 2014

(54) BRUSH FOR CLEANING A CONTAINER

(75) Inventor: Jean-Pierre Duwa, Marlhes (FR)

(73) Assignee: Duwa Brosses (FR)

( * ) Notice: Subject to any disclaimer, the term of this patent is extended or adjusted under 35 U.S.C. 154(b) by 0 days.

(21) Appl. No.: 13/389,310

(22) PCT Filed: Jul. 29, 2010

(86) PCT No.: PCT/FR2010/051610

§ 371 (c)(1),
(2), (4) Date: May 4, 2012

(87) PCT Pub. No.: WO2011/015774

PCT Pub. Date: Feb. 10, 2011

(65) Prior Publication Data

US 2012/0210529 A1 Aug. 23, 2012

(30) Foreign Application Priority Data

Aug. 7, 2009 (FR) ..... 09 55547

(51) Int. Cl.
*A46B 9/02* (2006.01)
*A47L 17/00* (2006.01)

(52) U.S. Cl.
USPC ..... 15/164; 15/211

(58) Field of Classification Search
USPC ..... 15/164, 160, 211
See application file for complete search history.

(56) References Cited

U.S. PATENT DOCUMENTS

| | | | | |
|---|---|---|---|---|
| 1,389,957 | A * | 9/1921 | Martin | 15/160 |
| 2,041,985 | A * | 5/1936 | Wallace | 15/206 |
| 2,228,062 | A * | 1/1941 | Onitch | 15/160 |
| 6,775,874 | B2 * | 8/2004 | Horton | 15/165 |
| 2002/0112301 | A1 | 8/2002 | Lee et al. | |

FOREIGN PATENT DOCUMENTS

| | | | |
|---|---|---|---|
| EP | 0199835 | A1 | 11/1986 |
| GB | 1013436 | A | 12/1965 |
| JP | 2001-299668 | A | 10/2001 |

OTHER PUBLICATIONS

International Search Report issued Jan. 4, 2011 by European Patent Office re: PCT/FR2010/051610; citing: US 2002/112301 A1, GB 1 013 436 A, JP 2001-299668 A and EP 0 199 835 A1.

* cited by examiner

*Primary Examiner* — Randall Chin
(74) *Attorney, Agent, or Firm* — Cantor Colburn LLP

(57) ABSTRACT

A brush including a gripping handle combined with a cleaning head, wherein the cleaning head has a base forming an extension of the handle, including a peripheral wall and an end wall. The latter is located opposite the handle. Cleaning elements in the form of hairs are attached to the base. The base is, for example, substantially planar and has a rectangular cross-section. The hairs are arranged on two opposite sides of the base and at the end thereof, i.e. in the same plane as the base.

12 Claims, 6 Drawing Sheets

BRUSH FOR CLEANING A CONTAINER

TECHNICAL FIELD

The present invention relates to a brush for cleaning a container, in particular a bottle tank.

The invention applies more particularly, but not exclusively, to containers having an opening with reduced dimensions relative to the body of the container.

BRIEF DISCUSSION OF RELATED ART

Diagrammatically, a bottle has a generally transparent tank on which a nipple is retained.

It is necessary to clean the tank after each use. In fact, deposits may form in the tank, in particular milk or cereal, which requires a mechanical action inside the tank to unstick those deposits.

The difficulty of cleaning a bottle tank relates to the general cylindrical geometry with limited access through a circular opening with a diameter smaller than that of the tank.

The cleaning of the tank of a bottle is generally done using a brush.

Traditionally, a brush comprises a handle and a part forming a brush. The part forming the brush is in turn made up of a twist of metal wires from which hairs radially depart in a helix. These hairs are made up of synthetic fibers of the polyamide, polypropylene or similar type.

It is also possible to use a brush to clean a bottle tank, i.e. generally a plastic utensil comprising a gripping handle associated with a cleaning head made up of a base in which tufts of hair are implanted.

For these tufts of hair to be fastened correctly, the volume of the base must be proportioned as a function of the number and diameter of the tufts.

To clean a bottle tank, two types of brushes are primarily found:

- a brush of the ball type comprising a base on which tufts of hair are arranged radially as well as at the end. To allow the passage of the brush into the neck of the bottle, the volume of the base must be small, limiting the number of tufts, which makes the cleaning fairly ineffective.
- a brush of the whisk type on which the tufts of hair are distributed over a single surface of the base and sometimes at the end. Here again, the volume of the base must correspond to the number of tufts of the brush so as to pass into the neck of the bottle. This brush is fairly ineffective, as it only has tufts on a single surface of the base. Furthermore, the surface of the base opposite the tufts of hair risks scratching the inner surface of the bottle.

It thus appears that, irrespective of the cleaning utensil used in a bottle tank, the latter may be imperfectly cleaned, or even scratched as well.

Furthermore, the current brushes or swabs are bulky due to their hairs or tufts of hair, which makes their storage problematic. This can prove problematic in itinerant use, since the brush or swab is transported in a bag with other utensils with which the repeated contact ends up flattening the hairs, which makes them completely ineffective.

Document US 2002/0112301 describes a bottle brush comprising a stopper on the one hand cooperating with the neck of the bottle, and a part provided with hairs on the other hand that deforms when it is inserted into the bottle. The washing of the inside of the bottle is done by rotating the brush, using the stopper. The major drawback of this brush is that it is designed for a particular geometry and dimensions of the bottle. In other words, it is necessary to provide a brush adapted to each bottle type or size.

BRIEF SUMMARY

In this technical context, one aim of the invention is to propose a cleaning utensil, in particular for a bottle tank, that offers better effectiveness than the known brushes and swabs and that can be easy to store.

To that end, the invention relates to a brush for cleaning a container, in particular a bottle tank, including a gripping handle combined with a cleaning head, the cleaning head including:

- a base forming an extension of the handle, including a peripheral wall and an end wall, the latter being located opposite the handle;
- cleaning elements attached onto the base.

According to a general definition of the invention, the brush is such that the cleaning elements are attached on the base only at an attachment zone substantially in the shape of a U having:

- two branches that extend along the peripheral wall of the base, between the handle and the end of the base, the branches being substantially parallel to one another and situated opposite one another relative to the base; and
- a junction portion connecting the two branches, extending on the end wall of the base, all of the cleaning elements thus fitting into a globally flat volume with a small thickness.

Thus, the invention offers an original brush that has cleaning elements fitting into a thin volume, globally flat or even planar. One thus has a single globally flat assembly of cleaning elements.

"Flat" means that the set of cleaning elements is not necessarily perfectly flat, but has a middle plane generally combined with the middle plane of the base.

Furthermore, according to one advantageous embodiment, the assembly of the cleaning elements assumes the general shape of a thin volume that is substantially planar, i.e. not curved, and preferably substantially combined with the middle plane of the base.

"Opposite one another relative to the base" means that the branches of the U-shaped attachment zone are situated on either side of the base, and are arranged "back to back," i.e. are oriented in different directions and not turned in the same direction.

It is for example possible to provide that the cleaning elements attached at a branch of the U-shaped attachment zone extend from that branch globally in a direction opposite the direction in which the cleaning elements extend that are attached at the other branch of the U-shaped attachment zone.

It will be noted that the cleaning elements do not necessarily continuously cover the entire surface of the U-shaped attachment zone, but can be arranged discontinuously—for example in tufts of hair—along that entire surface.

This brush therefore has a bulk much smaller than that of traditional brushes, which allows it to be stored more easily. Furthermore, the brush according to the invention allows better cleaning because the cleaning elements are concentrated in a flat volume. This arrangement has the advantage of reconciling the ease of insertion into the tank of a bottle and the ability to unstick any residue that adheres to the inner surface of the tank. Another important advantage of the invention is that the brush is universal, i.e. it can be used with all types and sizes of bottles.

The base can be bi-injected with the handle. Alternatively, the base and the handle are two separate pieces that can be assembled to one another, possible so they can be disassembled. Providing the brush in two separate pieces facilitates transport and storage and makes it possible to replace the cleaning head while keeping the same handle.

Preferably, the base has an elongated shape so as to facilitate the insertion of the base into the bottle and to allow it to reach the bottom of the bottle.

According to one possible embodiment, the base extends along a substantially rectilinear longitudinal axis. In this embodiment, the base can have a planar profile, and it is also possible to provide that the cleaning elements are arranged substantially in the plane of the base.

According to another embodiment, the base extends in a curved longitudinal direction or a direction forming a broken line. In this embodiment, the branches of the U forming the attachment zone follow the geometry of the base, i.e. are also curved (for example in an arc of circle or an S) or also form a broken line. The base can have a skewed (i.e. three dimensional) profile, for example with a small thickness.

It is possible to provide that the base has a flattened shape with a substantially rectangular transverse section, the cleaning elements being attached only on two opposite peripheral surfaces of the base and on the end wall of the base. For example, the cleaning elements can be attached on the peripheral surfaces corresponding to the small sides of the rectangle. One skilled in the art will understand that, similarly, the base could assume any other flattened shape, in particular, but not exclusively, oval.

According to one possible embodiment, the cleaning elements extend from the base while being oriented relative to the perpendicular at the connecting zone by an angle comprised between −30° and +30°. It is for example possible to provide that this is a non-zero angle.

Alternatively, the cleaning elements extend from the base substantially perpendicularly to the connecting zone. The cleaning elements can then form a flat, or even planar, assembly with a small thickness.

Typically, the cleaning elements belong to the group comprising: hairs arranged in tufts, separate or in sheets, flexible spurs, flexible strips. The configuration in a sheet of substantially continuous hairs makes it possible to consider a particularly rapid manufacturing process of the brush.

According to the different possible embodiments, the cleaning elements comprise hairs arranged in at least one sheet attached to the base by welding, adhesion or mechanical snapping; and/or the cleaning elements comprise hairs arranged in separate tufts, distributed in one or more rows.

The base can comprise at least one peripheral groove forming the connecting zone between the cleaning elements and the base, at least one sheet of hairs being engaged in the or each groove.

The base can be made from a flexible material allowing the base to assume a deformed configuration—for example helical—during insertion into the tank of a bottle. This embodiment is particularly advantageous since it provides for flexibility of the base for greater cleaning efficiency. As an example, the component material of the base can have a flexibility comprised between 50 and 80 Shore A.

The base can also have a rounded portion at its end opposite that connected to the handle, so as to ensure the cleaning of the bottom of the tank.

It can also be provided that the base has a central notch. This arrangement is more particularly advantageous in the scenario where the base is flexible, since the notch contributes to the flexibility of the base.

BRIEF DESCRIPTION OF THE DRAWINGS

For a proper understanding thereof, the invention is described in reference to the appended diagrammatic drawing showing, as non-limiting examples, several embodiments of a brush according thereto.

DETAILED DESCRIPTION

Figure 1:
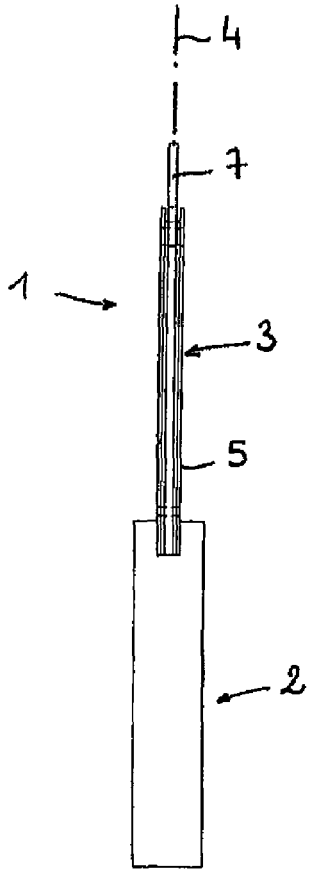
FIGS. 1 to 3 show a brush according to a first embodiment, in side view, front view, and top view, respectively.
Figure 2:
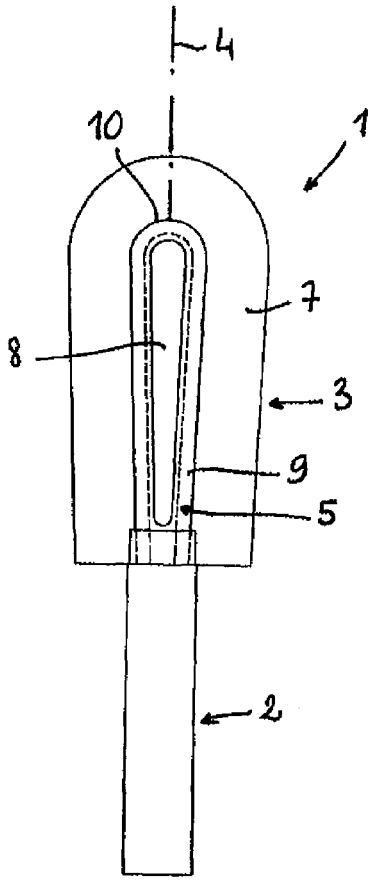
Figure 3:
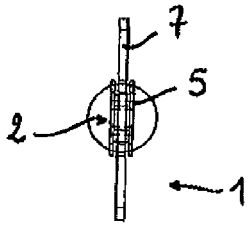

In reference first to FIGS. 1 and 2, one can see that the brush 1 according to the invention essentially has two parts, i.e. a gripping handle 2 with a cleaning head 3 alongside it.

The gripping handle 2 is shown in the figures by a cylindrical element. Other embodiments of the handle 2 are of course considered, in particular embodiments allowing better ergonomics.

The brush 1 according to this first embodiment has a completely unique cleaning head 3, since it is essentially planar.

Figure 7:
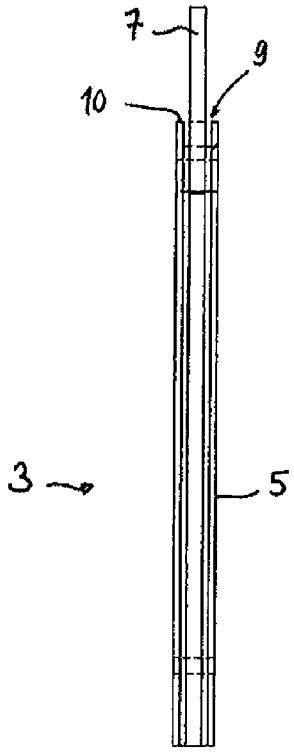
FIGS. 7 to 9 show, on an enlarged scale, part of the brush according to the invention, in side view, front view, and top view, respectively.
Figure 8:
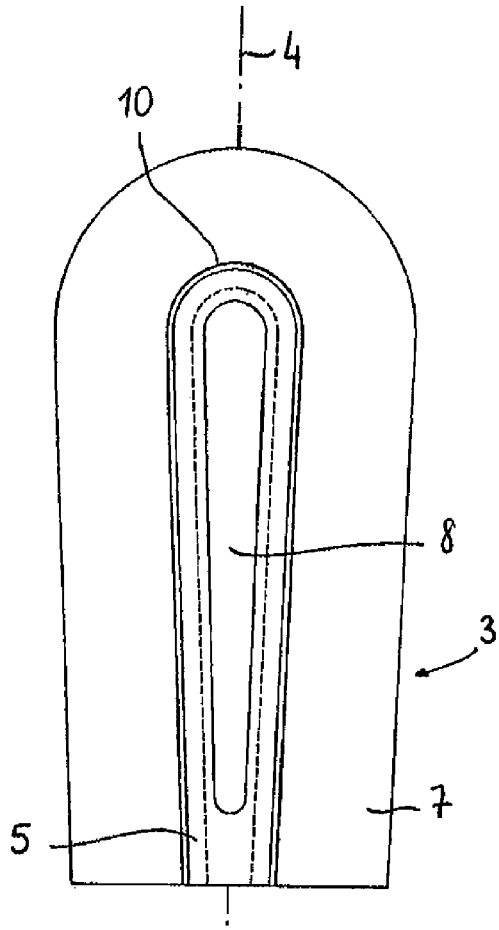
Figure 9:
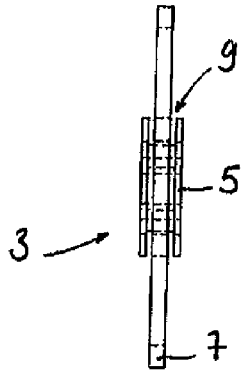

In fact, the cleaning head 3, as can be seen more precisely in FIGS. 7 to 9, has a base 5 that is attached on the handle 2, said base 5 receiving a continuous planar sheet 7 of hairs.

Within the meaning of the present document, the term "hairs" refers to strands of a flexible synthetic material of the polyamide, polypropylene, pvc or polyester type whereof the diameter can vary between 0.10 and 0.50 millimeters. With fine hairs having a diameter in the vicinity of 0.20 mm, the risks of scratching the container are considerably reduced.

More generally, cleaning elements other than hairs can be used, such as flexible spurs or flexible strips.

In the example illustrated in the figures, the base 5 has a general elongated prismatic shape whereof the sides are convergent toward the gripping handle 2 of the brush. At its end opposite that attached to the handle 2, the base 5 has a rounded end 10. In the illustrated embodiment, the base 5 has a substantially rectangular transverse section and therefore has a peripheral wall comprising two small surfaces and two large surfaces.

The sheet 7 of hairs here extends perpendicularly to the surface of the base 5 to which it is attached.

It will also be noted that the base 5 can comprise a central notch 8.

If for example we refer to FIGS. 7 and 9, it appears that the base 5 has, on its periphery, a groove 9 in which the sheet 7 of hairs is inserted. The sheet 7 of hairs can be attached on the base 5 through various attachment means such as adhesion, welding, or mechanical snapping.

The bottom of the groove 9 forms an attachment zone between the hairs and the base 5. This attachment zone thus assumes the shape of a U with two branches extending on the small surfaces of the base 5, substantially along the longitudinal axis 4 of the base 5, and a junction portion connecting the two branches, extending over a rounded end 10 of the base 5.

One can see that the brush according to this first embodiment of the invention therefore has a planar cleaning head 3, which distinguishes it from traditional brushes in which the hairs are distributed radially generally around an axis made from twisted iron wires.

In the example illustrated in the figures, the sheet 7 of hairs generally assumes the shape of a U.

It can be specified that the sheet 7 of hairs is in turn made up of a profile of juxtaposed hairs connected to one another at a shared base. This type of profile can be available over large lengths that are cut to the dimension of the base 5, then are attached thereto using one of the aforementioned techniques.

Another unique arrangement of the brush according to the invention lies in the fact that the base 5 can be made from a flexible material. This arrangement proves quite interesting inasmuch as it allows a deformation of the base 5, as will be seen later.

In the case where the base 5 is made from a flexible material, which is therefore separate from the plastic material from which the gripping handle 2 is made, it can be provided for the gripping handle 2 and the base 5 of the brush to be made in a bi-material injection operation.

With use, when the brush is engaged in the tank of a bottle, it has the ability to assume a deformed configuration, for example substantially helical, so that the hairs come into contact with all of the inner surfaces of the tank, in particular, the hard-to-clean zones such as the concave and convex zones and the corners between the bottom of the tank and the cylindrical wall. In this way, it is possible to unstick any material residue.

Figure 4:
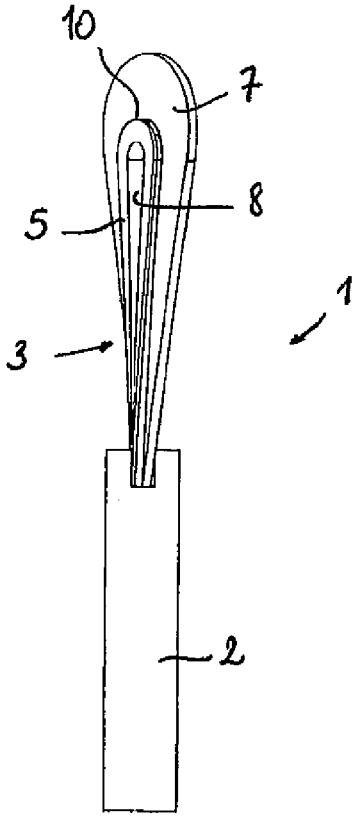
FIGS. 4 to 6 show the brush defined in the preceding figures in the case of twisting, in side view, front view, and top view, respectively.
Figure 5:
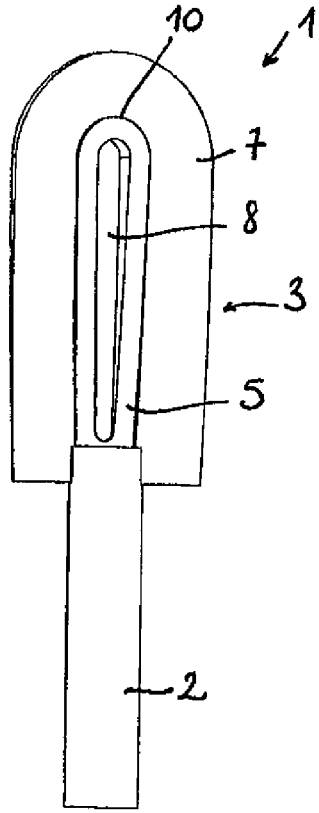
Figure 6:
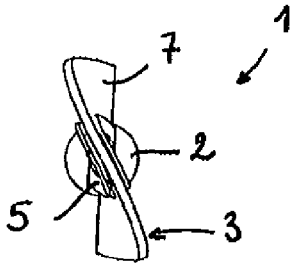

FIGS. 4 to 6 thus show the ability of the cleaning head 3 to deform around its longitudinal axis 4. The fact that the base 5 is equipped with a notch 8 facilitates the twisting of the cleaning head 3 and improves the flexibility of the brush 1.

Figure 10:
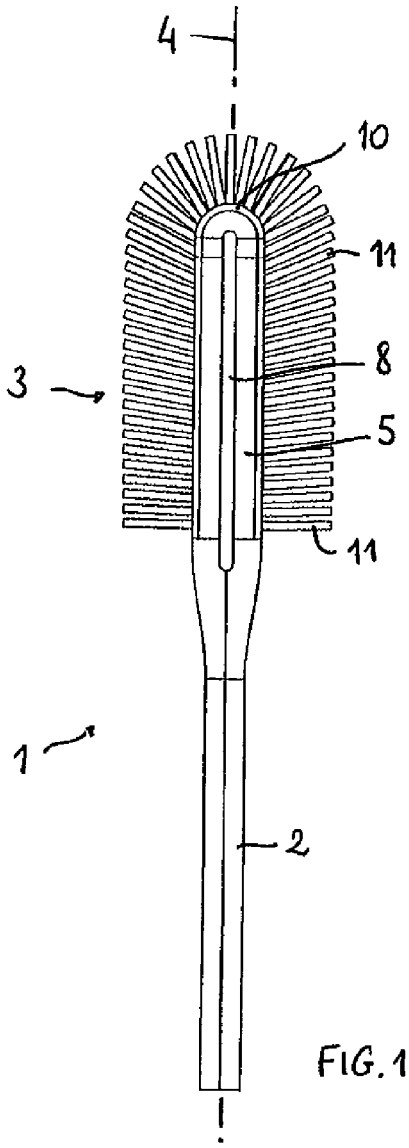
FIGS. 10 to 12 show a brush according to a second embodiment, in front view, side view, and top view, respectively.
Figure 11:
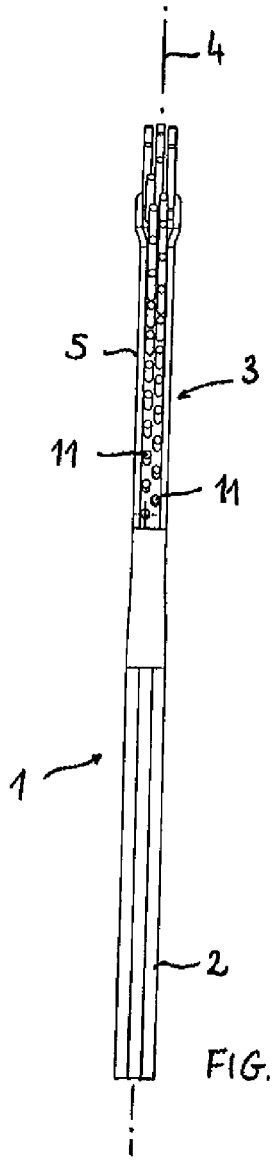
Figure 12:
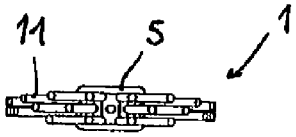

FIGS. 10 to 12 show a second embodiment of the invention in which the hairs are distributed in two rows of tufts 11 in staggered rows. The general shape of the base and the hair assembly is also similar to the first embodiment. In particular, the tufts 11 of hair are substantially perpendicular to the surface of the base 5 from which they extend.

This embodiment of the invention makes it possible to preserve the planarity of the brush 1 and therefore the resulting advantage in terms of storage.

In this embodiment, the unsticking of the residue inside the tank of the bottle is done by bending the tufts 11 of hair themselves.

Figure 13:
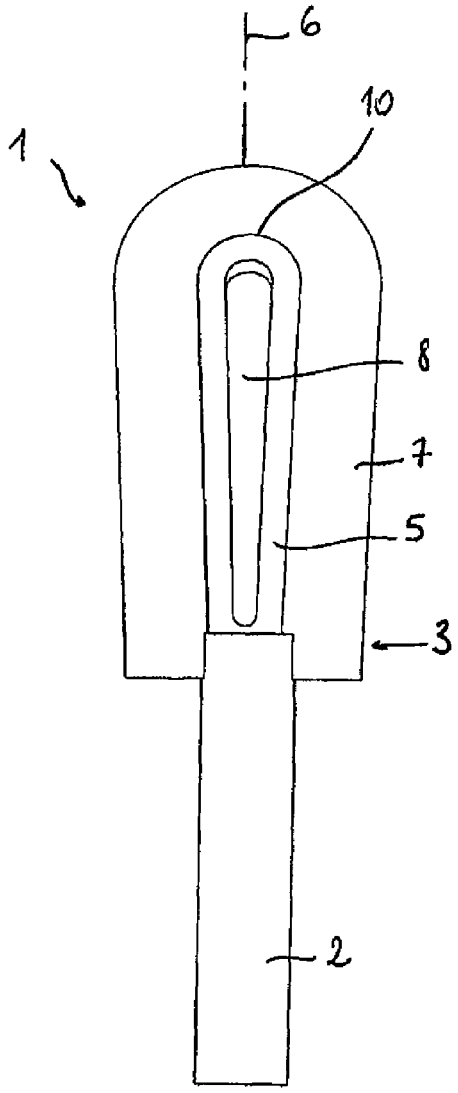
FIGS. 13 and 14 show a brush according to a third embodiment, in front view and side view, respectively.
Figure 14:
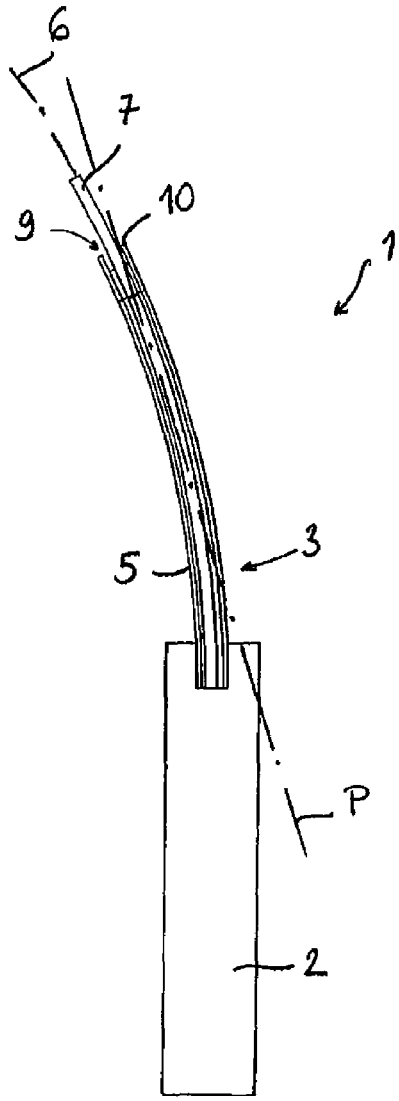

We will now refer to FIGS. 13 and 14, which illustrate a third embodiment of the invention.

The brush 1 is substantially identical to that described in reference to FIGS. 1 to 9, with the exception of the fact that the base 5 is not planar, but skewed (i.e. three dimensional).

The base 5 thus extends in the extension of the handle 2 in a curved longitudinal direction 6. The attachment zone of the sheet 7 of hairs on the base therefore forms a skewed U, and the sheet 7 of hairs follows the general shape of the base 5, while keeping the general shape of a flat volume with a small thickness. The base 5 has a middle plane P, which is also the middle plane of the sheet 7 of hairs.

Figure 15:
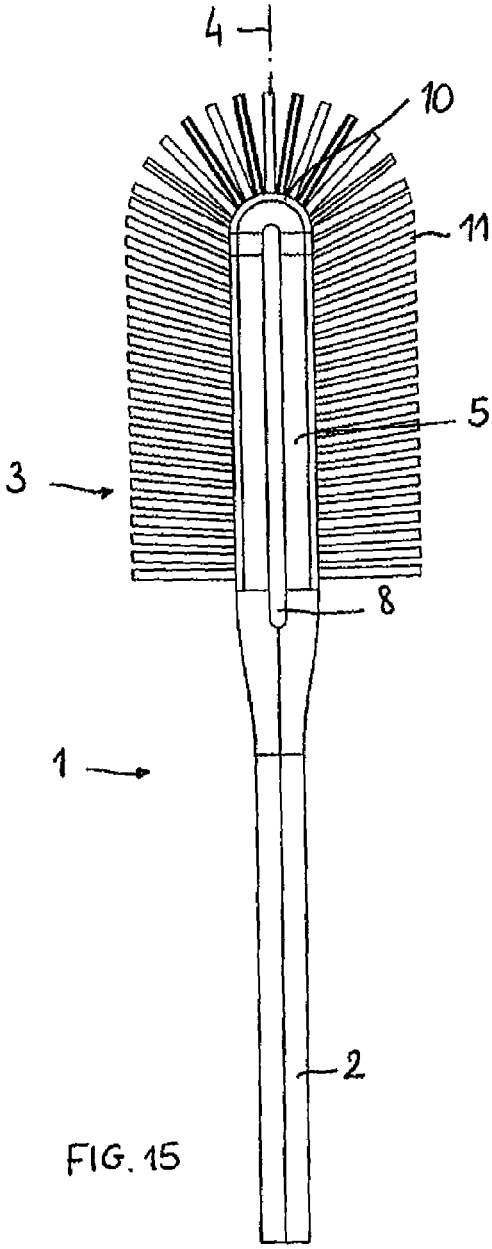
FIGS. 15 to 17 show a brush according to a fourth embodiment, in front view, side view, and top view, respectively.
Figure 16:
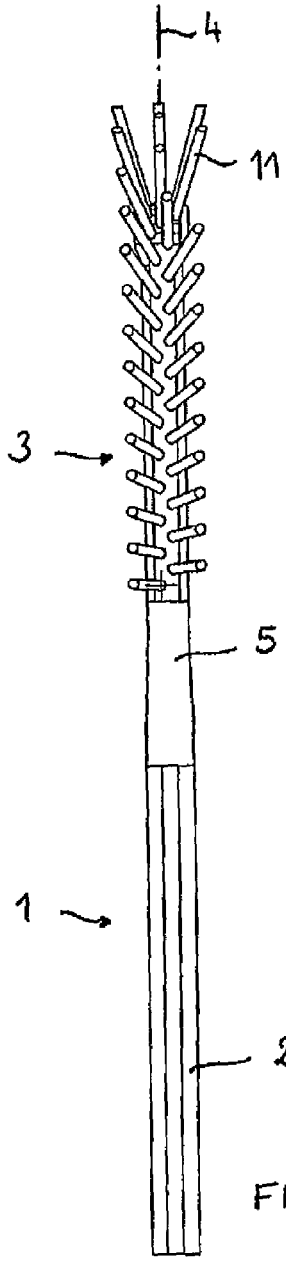
Figure 17:
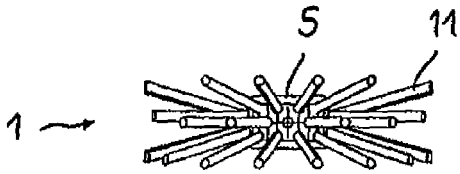

Lastly, a fourth embodiment of the invention is described, illustrated in FIGS. 15 to 17.

The brush 1 is generally identical to that illustrated in FIGS. 10 to 12, with the exception of the fact that the tufts 11 of hairs are inclined here relative to the perpendicular at the surface of the base 5 where said hairs are attached. This incline can be comprised between −30° and +30°.

Alternatively, the inclined tufts 11 of hairs could be replaced by inclined sheets of hairs. One or more sheets can thus be attached in a groove of the base 5, the base being able to comprise several grooves. The incline of a sheet is for example obtained by inclining the bottom of the groove on which the sheet is attached.

It should be specified that, irrespective of the embodiment, the brush according to the invention has a high concentration of hairs on a small surface, much higher than the concentration of a traditional brush in which the hairs are radially distributed with a low density over the entire perimeter.

A high concentration of hairs allows the brush according to the invention to exert a better mechanical force and thus to unstick the deposits of milk or cereal more easily, particularly in the hard-to-clean zones.

In this way, the cleaning head 3 has, due to its high concentration of strands, greater liveliness and can also be used, for example, to clean the screw pitch of the tank in which milk residue can also be deposited.

Of course, the invention is not limited to the embodiments described, as non-limiting examples, but on the contrary encompasses all embodiments thereof.

The invention claimed is:

1. A brush for cleaning a container including a gripping handle combined with a cleaning head, the cleaning head including:

a base arranged in an extension of the handle, including a peripheral wall and an end wall located opposite the handle, the base being made from a flexible material allowing the base to assume a deformed configuration during insertion into the tank of a bottle;

cleaning elements attached onto the base;

wherein the cleaning elements are attached on the base only at an attachment zone substantially in the shape of a U having:

two branches that extend along the peripheral wall of the base, between the handle and the end wall of the base, the branches being substantially parallel to one another and situated opposite one another relative to the base; and a junction portion connecting the two branches, extending on the end wall of the base, the cleaning elements forming a single globally flat assembly .

2. The brush according to claim 1, wherein the base extends along a substantially rectilinear longitudinal axis.

3. The brush according to claim 1, wherein the base extends in a curved longitudinal direction or a direction forming a broken line.

4. The brush according to claim 1, wherein the base has a flattened shape with a substantially rectangular transverse section, the cleaning elements being attached only on two opposite peripheral surfaces of the base and on the end wall of the base.

5. The brush according to claim 1, wherein the cleaning elements extend from the base at an angle of inclination between −30° and +30° measured from the perpendicular with respect to the base.

6. The brush according to claim 1, wherein the cleaning elements extend from the base substantially perpendicularly to the attachment zone.

7. The brush according to claim 1, wherein the cleaning elements comprise at least one of hairs arranged in tufts, separate or in sheets, flexible spurs, and flexible strips.

8. The brush according to claim 1, wherein the cleaning elements comprise hairs arranged in at least one sheet attached to the base by welding, adhesion or mechanical snapping.

9. The brush according to claim 1, wherein the cleaning elements comprise hairs arranged in separate tufts, distributed in one or more rows.

10. The brush according to claim 1, wherein the base comprises at least one peripheral groove forming the attachment zone between the cleaning elements and the base, at least one sheet of hairs being engaged in the or each groove.

11. The brush according to claim 1, wherein the base has a rounded portion at an end opposite that connected to the handle.

12. The brush according to claim 1, wherein the base has a central notch.

* * * * *